US006938685B2

(12) United States Patent
Duerr et al.

(10) Patent No.: US 6,938,685 B2
(45) Date of Patent: Sep. 6, 2005

(54) HEAT EXCHANGER

(75) Inventors: Gottfried Duerr, Stuttgart (DE); Peter Geskes, Stuttgart (DE); Michael Kohl, Cleebronn (DE); Andreas Lelster, Neuenstein (DE); Kurt Molt, Bietigheim-Bissingen (DE); Emil Neumann, Stuttgart (DE); Franz Ott, Stuttgart (DE); Christian Rebinger, Stuttgart (DE); Wolfgang Seewald, Stuttgart (DE)

(73) Assignee: Behr GmbH & Co., Stuttgart (DE)

( * ) Notice: Subject to any disclaimer, the term of this patent is extended or adjusted under 35 U.S.C. 154(b) by 29 days.

(21) Appl. No.: 10/141,356

(22) Filed: May 9, 2002

(65) Prior Publication Data

US 2002/0195239 A1 Dec. 26, 2002

(30) Foreign Application Priority Data

May 11, 2001 (DE) ..... 101 22 925
Sep. 7, 2001 (DE) ..... 201 14 850 U

(51) Int. Cl.[7] ..... F28D 1/03; F28F 3/04

(52) U.S. Cl. ..... 165/148; 165/153; 165/170; 165/179

(58) Field of Search ..... 165/148, 153, 165/170, 177, 179

(56) References Cited

U.S. PATENT DOCUMENTS

| | | | | | |
|---|---|---|---|---|---|
| 1,376,882 | A | * | 5/1921 | Hromadko | 165/153 |
| 1,417,387 | A | * | 5/1922 | Jungerheld | 165/148 |
| 1,747,115 | A | * | 2/1930 | Higgins | 165/153 |
| 3,554,150 | A | * | 1/1971 | Goetschius et al. | 165/179 |
| 4,209,064 | A | * | 6/1980 | Cacalloro et al. | 165/170 |
| 4,470,455 | A | * | 9/1984 | Sacca | 165/153 |
| 4,696,342 | A | * | 9/1987 | Yamauchi et al. | 165/153 |
| 4,751,964 | A | * | 6/1988 | Borbely et al. | 165/179 |
| 5,507,338 | A | | 4/1996 | Schornhorst et al. | |
| 5,701,760 | A | | 12/1997 | Torigoe et al. | |
| 5,735,343 | A | | 4/1998 | Kajikawa et al. | |
| 5,855,240 | A | | 1/1999 | Farrell et al. | |
| 6,016,865 | A | * | 1/2000 | Blomgren | 165/148 |
| 6,047,769 | A | | 4/2000 | Shimoya et al. | |
| 6,289,982 | B1 | | 9/2001 | Naji | |
| 6,318,455 | B1 | | 11/2001 | Nakado et al. | |
| 6,321,835 | B1 | * | 11/2001 | Damsohn et al. | 165/170 |
| 6,364,006 | B1 | * | 4/2002 | Halt et al. | 165/148 |

FOREIGN PATENT DOCUMENTS

| | | | | |
|---|---|---|---|---|
| AT | 406 301 | | 4/2000 | |
| DE | 43 08 858 | | 9/1994 | |
| DE | 43 33 164 | | 3/1995 | |
| DE | 44 31 413 | | 2/1996 | |
| DE | 198 38 215 | | 2/2000 | |
| DE | 199 63 797 | | 7/2000 | |
| DE | 100 11 172 | | 9/2000 | |
| DE | 696 10 056 | | 1/2001 | |
| DE | 199 48 222 | | 4/2001 | |
| EP | 0 838 641 | | 4/1998 | |
| EP | 0 935 115 | | 8/1999 | |
| EP | 1 001 238 | | 5/2000 | |
| JP | 05172485 | A * | 7/1993 | 165/133 |
| JP | 2000-55573 | | 2/2000 | |
| JP | 2000-274965 | | 10/2000 | |

* cited by examiner

*Primary Examiner*—Leonard R. Leo
(74) *Attorney, Agent, or Firm*—Foley & Lardner LLP

(57) ABSTRACT

A heat exchanger (1) consists of a plurality of disks (4) which are assembled to form a heat exchanger block or disk stack (16) and which are formed in each case from sheets (22) joined together in pairs and enclose between them at least one cavity designed as a duct. The cavity is delimited by the insides of the sheets (22). In the duct, an internal fluid flows in the longitudinal direction of the disks (4) and, on the outside of the disks, an external fluid flows transversely to the direction of flow of the internal fluid. Each sheet (22) has elevations (26, 33') out of the disk plane, which are formed by material deformation and are directed both into the inside of the disk and toward the outside of the disk, the elevations (33') directed toward the outside of the disk being configured as elongate stamped-out portions.

24 Claims, 12 Drawing Sheets

HEAT EXCHANGER

The invention relates to a heat exchanger of the generic type specified in the preamble of claim 1.

EP O 935 115 A2 discloses a heat exchanger consisting of heat-conducting plates which are assembled in pairs and have a multiplicity of outward-pointing ribs. Passages for a coolant are formed within a pair of heat-conducting plates. Outside the plates, air flows perpendicularly to the direction of flow of the coolant. The ribs prevent the air from passing the plates in a straight line and generate a turbulent flow.

DE 43 08 858 A1 describes a disk-type heat exchanger, the disks of which consist of two identical sheets. These sheets possess on both sides of a sheet plane, frustoconical stamped-out portions, the top side of which bears on a corresponding face of the next sheet in each case. Flow ducts for the fluids involved in the heat exchange are thereby formed between the sheets of one disk and between adjacent disks.

The object on which the invention is based is to provide a heat exchanger of the generic type which, along with simple construction and cost-effective production, offers improved heat transmission.

This object is achieved by means of a heat exchanger having the features of claim 1.

The design of the elevations on the outside of the disks as beads leads to a high heat transmission capacity being achieved, along with a low air-side pressure drop. The production of correspondingly configured sheets, small drawing depths are necessary in order to achieve the required flow cross sections. As a result, hard and corrosion-resistant materials can be used for the sheets. Hard materials mean a smaller required wall thickness for the sheets and therefore a weight reduction and/or higher rigidity of the heat exchanger.

According to a preferred embodiment, the beads in a sheet have different lengths. The beads may have, for example, a width of 1 mm to 4 mm and a length of 3 mm to 50 mm. By virtue of this configuration of the beads, the external fluid, when flowing through the disk stack, is deflected both in the longitudinal direction and perpendicularly to the disk surface of the disks. The flow velocity of the external fluid is raised and the heat transmission is thereby increased. Adjacent disks are soldered to one another, particularly at contact points between intersecting elongate elevations, with the result that the stability of the evaporator is increased. In particular, the beads are formed with a different height over their length, intersecting beads being soldered, in particular, in regions of large height. The beads expediently have two heights, the ratio of the small height to the large height being 0.2 to 0.8. A run of the beads at an angle of approximately 30° with respect to the onflow direction of the external fluid is considered to be particularly beneficial. In a refinement of the invention, those elevations of the sheets which are directed towards the inside of the disk are designed as bosses. The bosses expediently have an oval base with a width of 1.5 mm to 4 mm and a length of about 2.5 mm to 25 mm. This configuration of the bosses results in a favorable flow routing for the internal fluid. The oval design of the bosses brings about a high rigidity of the sheets and therefore of the entire heat exchanger. In particular, sheets forming a disk are soldered to one another on contact faces which are formed between bosses which are in contact with one another. This results in a firm connection which is favorable in flow terms. The increased free flow cross section leads to a reduction in the pressure loss in the internal fluid. It may be expedient for those elevations of the sheets which are directed toward the inside of the disk to be designed as beads. In particular, sheets forming a disk are soldered at contact points between intersecting beads.

The sheets have, in particular, a wall thickness of 0.25 mm to 0.40 mm, a width of 35 mm to 70 mm and a length of 200 mm to 270 mm.

Expediently, in a disk, two parallel ducts are formed, which are delimited by edge webs arranged on the sheets on the longitudinal sides and by a middle web arranged in the middle in the longitudinal direction, the webs projecting toward the inside of the disk and webs being soldered to one another on the inside and at the edge of the disks. The ducts have, in particular, a width of 7.5 mm to 40 mm. Particularly when the beads are arranged at an inclination to the longitudinal direction of the disk, a good condensate outflow is achieved.

Expediently, in one region on the sheet, the elevations are arranged on the sheet in a pattern which is repeated according to a longitudinal portion of the sheet. A uniform flow profile is thereby achieved. The length of the longitudinal portion is expediently 10 mm to 35 mm. In particular, two elevations directed towards the inside of the disk are formed in each longitudinal portion in the longitudinal direction of a sheet, with the result that a high stability of the heat exchanger is achieved.

There is provision for there to be formed in each longitudinal portion in each duct two elevations which are directed toward the outside of the disk and which, in particular, are offset relative to one another in the longitudinal direction of the disk, the amount by which the elevations are offset relative to one another expediently corresponding to the longitudinal division. In this case, the length of the beads may be greater than the longitudinal division. Expediently, the ratio of the transverse division, which designates the total height of a disk, to the inlet gap width, which designates the width of the gap through which the external fluid can flow in between two disks adjacent to one another on the outside, is 4:3 to 4:1. A high heat transmission to the external fluid is achieved by means of the relatively small inlet gap width.

Expediently, rim holes, which form a collecting duct in the longitudinal direction of the heat exchanger, are produced at at least one end of the ducts. In particular, rim holes are produced at each end of the ducts, so that, in the case of two ducts, four collecting ducts are formed. Expediently, in that region of a sheet which is contiguous to the collecting duct, elevations are formed in the disk, which are designed as inflow bosses and which, in particular, have a larger base than the bosses. Expediently, the inflow bosses point toward the inside of the disk. For the inlet and outlet of the internal fluid, there is provision for said inflow bosses to be arranged on the same side of the heat exchanger. This results in favorable conditions for the installation of the heat exchanger. The elevations are expediently produced by deep drawing. It may be advantageous, however, to produce the elevations by stamping.

Exemplary embodiments of the invention are explained below with reference to the drawing in which:

FIG. 1 shows a heat exchanger designed as a disk-type evaporator, in the view of the end face, FIG. 2 shows the illustration of a sheet comprising a plurality of basic elements, FIG. 3 shows an exploded illustration of a heat exchanger constructed from disks, FIG. 4 shows a perspective formation of two sheets, between which the external fluid flows, FIG. 5 shows a detail of a view of a disk from the disks illustrated in FIG. 4, FIG. 6 shows a section through a disk pack in a plane along the line VI—VI in FIG. 5, FIG. 7 shows a diagrammatic illustration of the flow profile in the heat exchanger illustrated in FIG. 3

Figure 12:
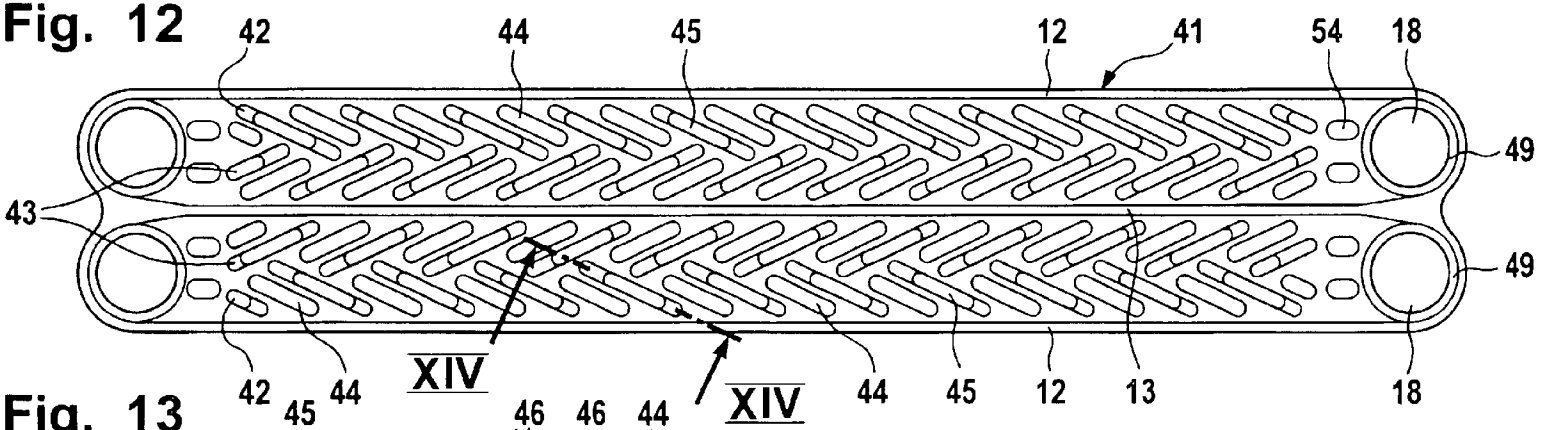
FIG. 12 shows a further embodiment of the sheets.
Figure 13:
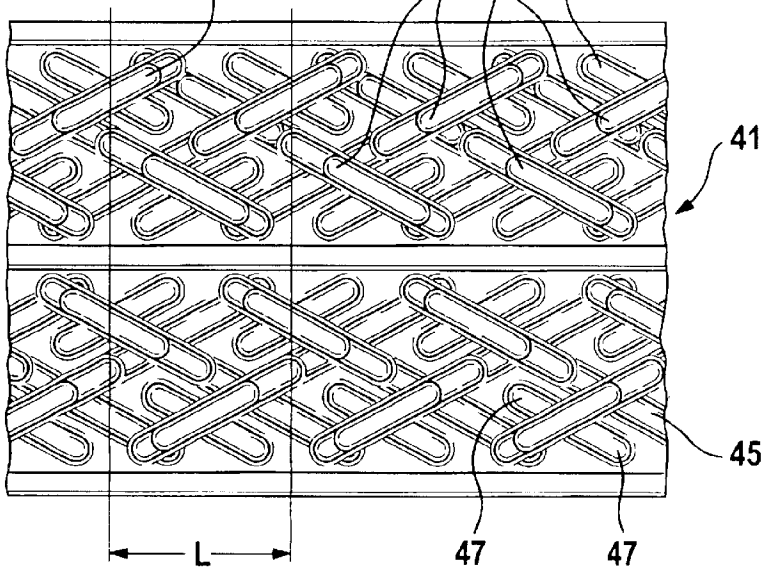
Figure 14:
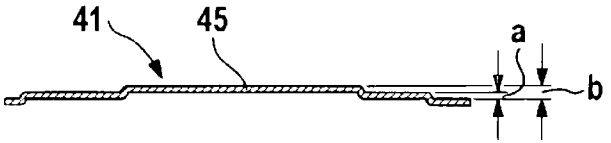
Figure 15:
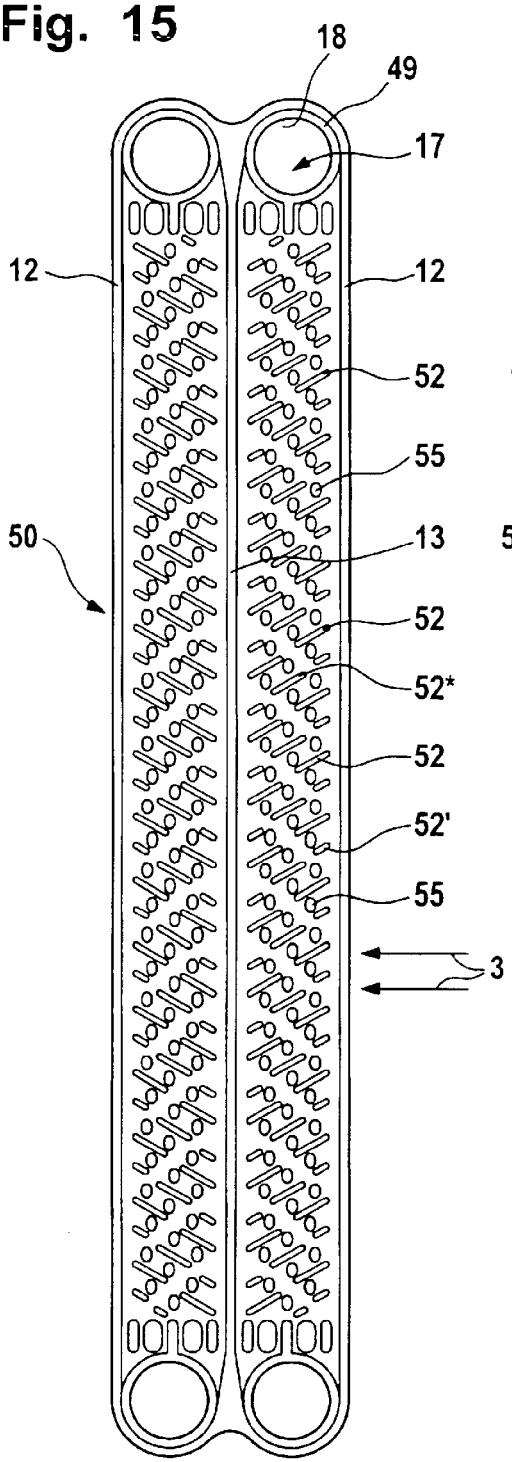
Figure 16:
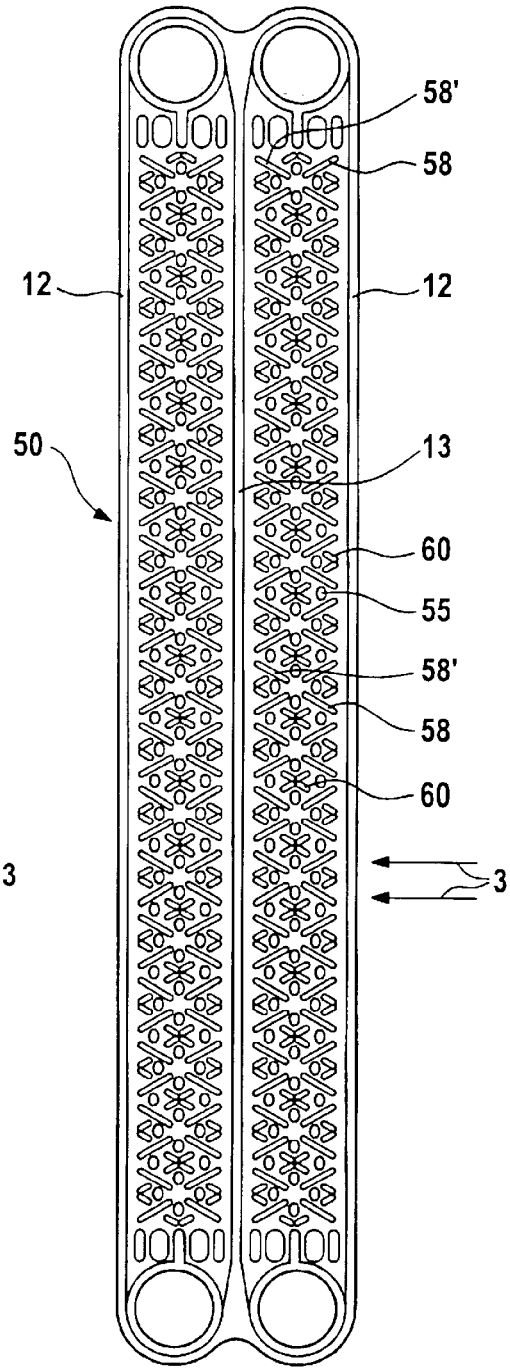
Figure 17:
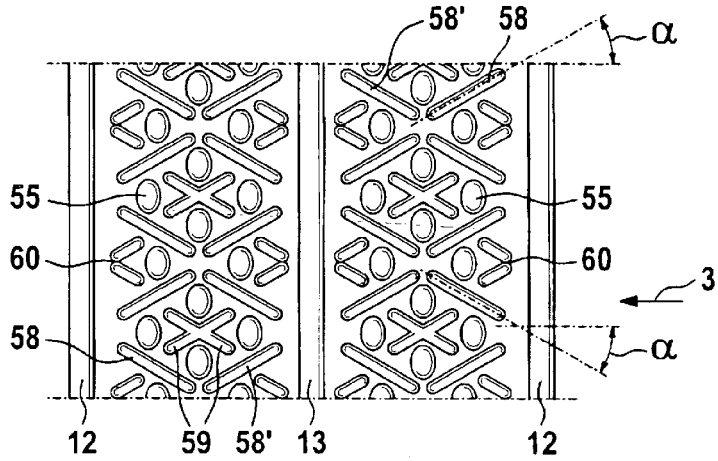
Figure 18:
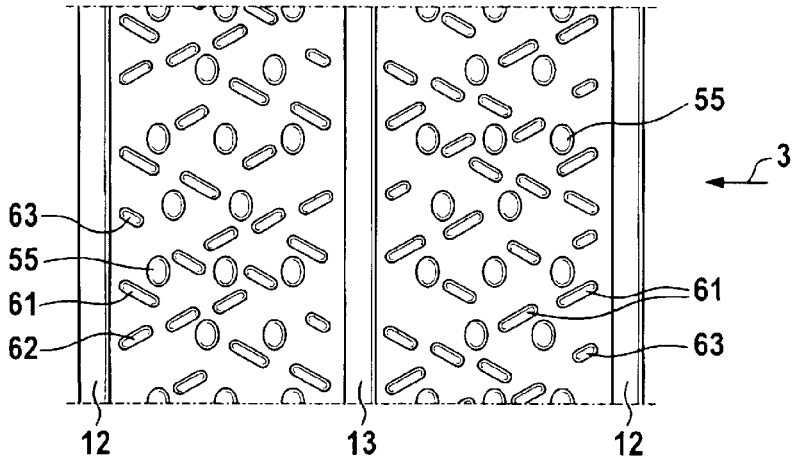
Figure 19:
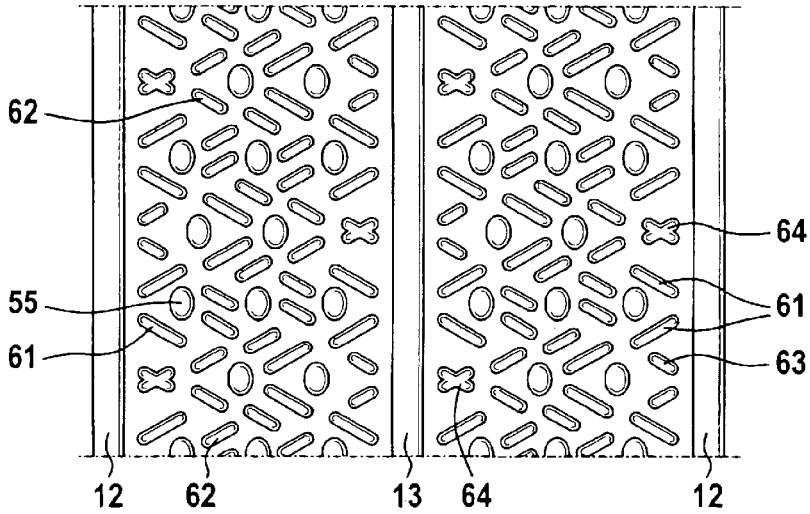
Figure 20:
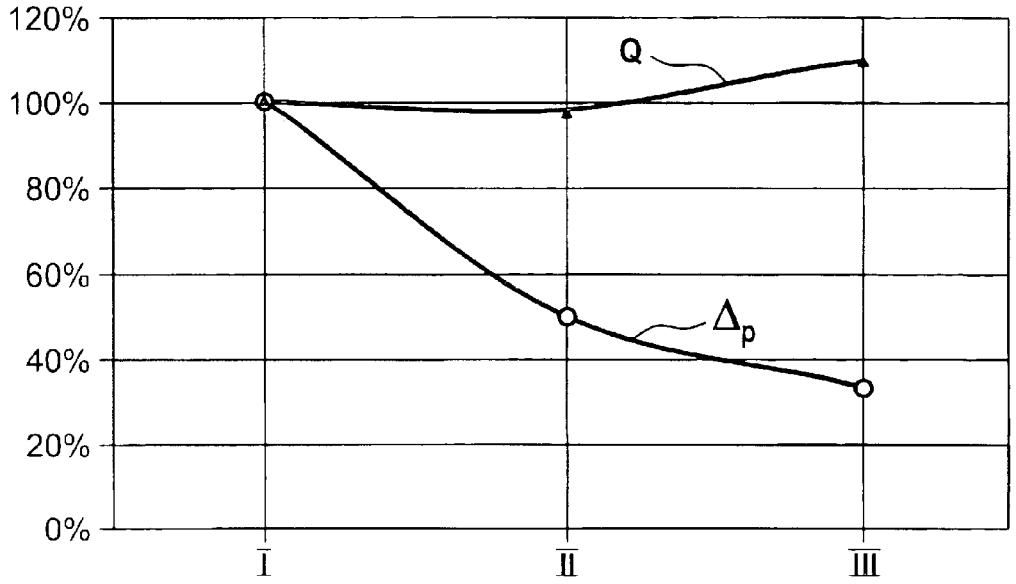
Figure 21:
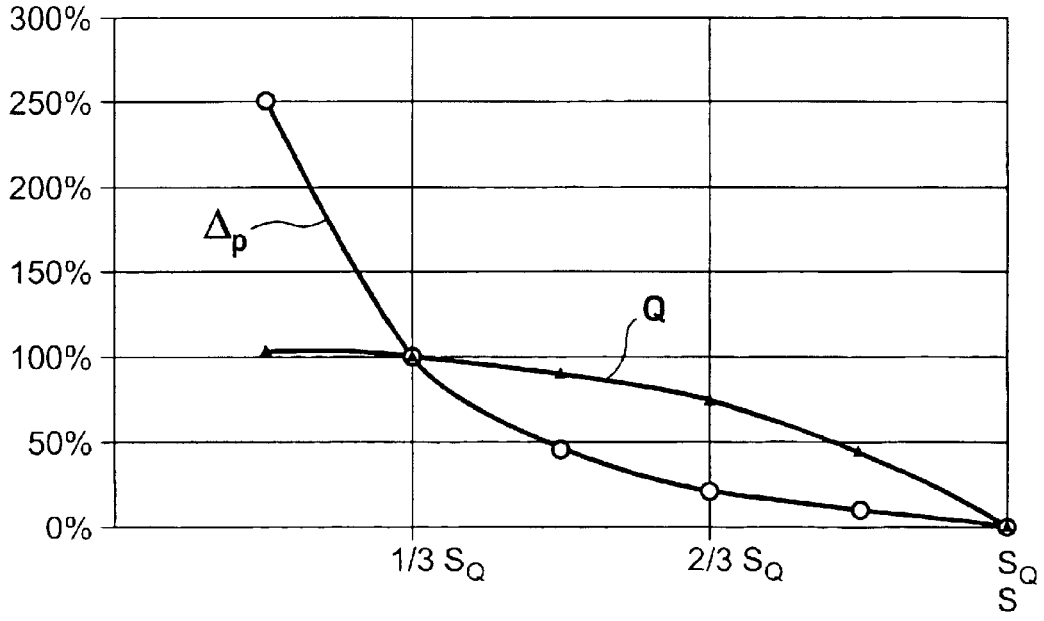

FIG. 13 shows a detail of a view of a sheet according to FIG. 12, with illustrated beads of the contiguous sheet, FIG. 14 shows a section along the line XIV—XIV in FIG. 12, FIGS. 15 and 16 show further design variants of sheets with different beads, FIG. 17 shows an enlarged illustration of a detail of the sheet according to FIG. 16, FIGS. 18 and 19 show details of further design variants of bead/boss structures, FIGS. 20 and 21 show graphs to illustrate the heat transmission capacity and the air-side pressure drop.

Figure 1:
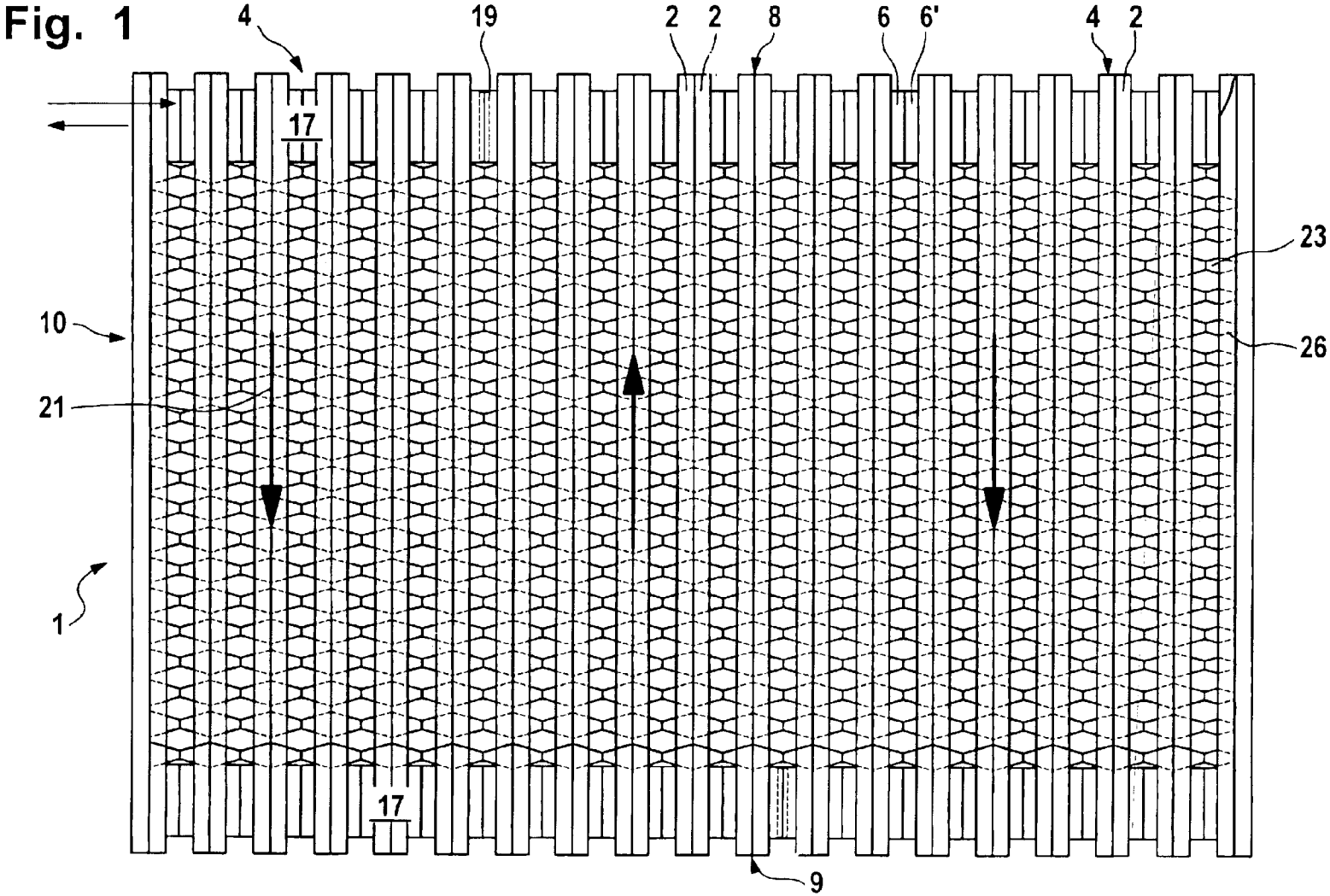

FIG. 1 shows a heat exchanger 1 which is preferably designed as a disk-type evaporator and is an integral part of an air-conditioning system, not described in any more detail here, of a motor vehicle. The disk-type evaporator 1 has a multiplicity of disks 4 which are assembled, stacked to form a block 10, and each consist of two sheet elements 2 joined to one another. The disks 4 form, under the influence of a cavity, tube elements for leading through a coolant. The disks 4 are of longitudinally elongated design and are fluidically connected to one another in such a way that the coolant flows through the disk-type evaporator 1 in the direction of the arrow 21. In order to achieve the flow path illustrated by the arrows 21, partitions 19 are arranged between specific disks 4.

Formed at the free ends 8,9 of the disks 4, in each case on the sheet elements 2 forming the disks 4, is a connection piece 6 which is connected to the connection piece 6' of the disk 4 which is adjacent in each case. The disks 4 lie in each case in congruence with one another in the disk block 10, a multiplicity of interspaces being formed, next to the ribs 33, for the passage of air to be cooled in the direction of the depths of the evaporator block. The depth of direction is in this case the direction which is perpendicular to the sheet plane of the drawing, that is to say the extent of the evaporator block in the direction perpendicular to its end face.

The sheet elements 2 are stamped in such a way that they have outward-projecting cooling webs 33 in the form of ribs. These cooling webs 33 are in bearing contact on the mirror-symmetrically arranged cooling webs of the disk 4 adjacent in each case and are soldered to these. Soldering results not only in an enlargement of the surface of the disks, but also in a higher strength of the disk-type evaporator 1. In addition to the outward-directed stamped-out portions of the sheet elements 2, inward-directed bosses 26 are also provided.

Figure 2:
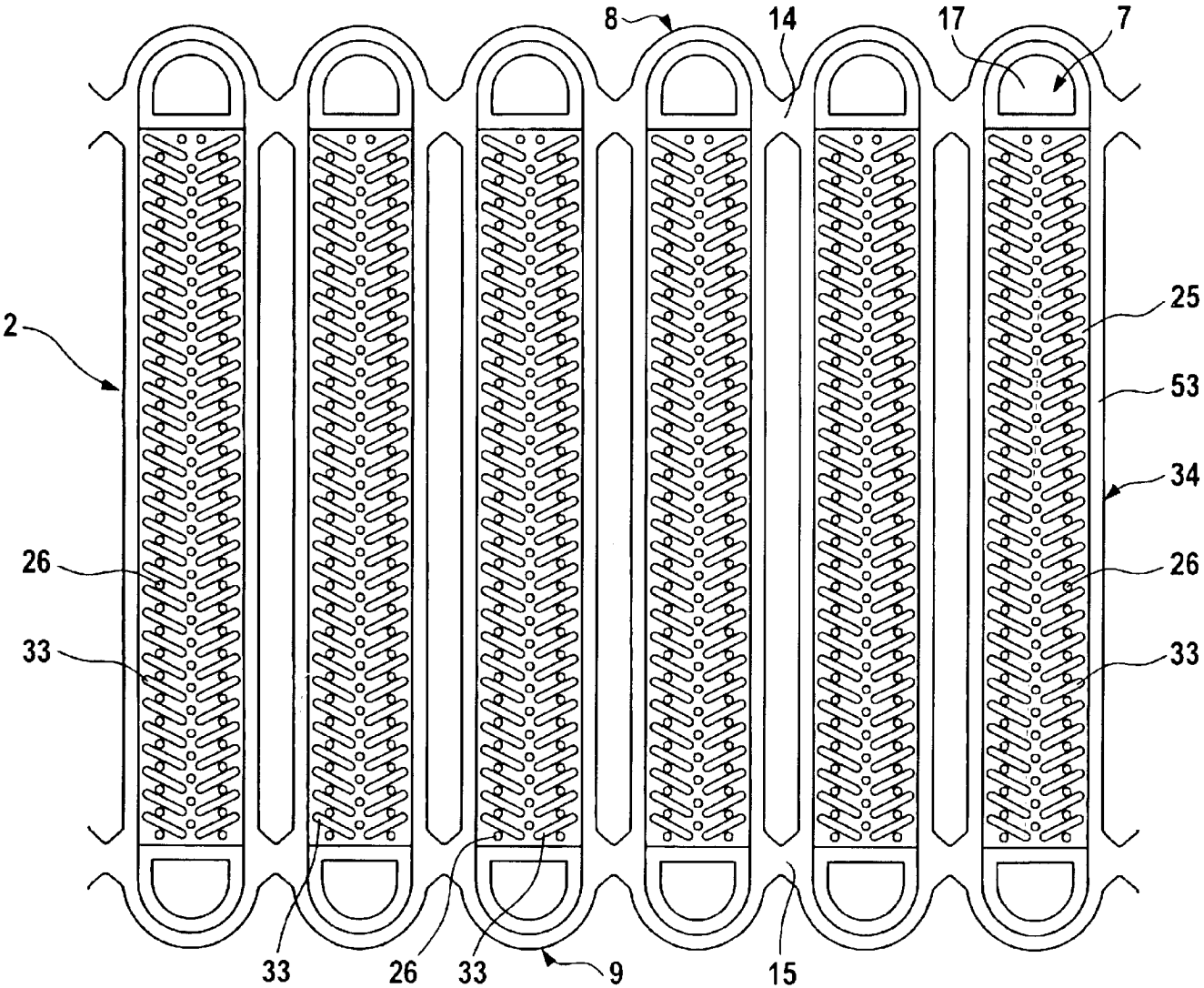

FIG. 2 shows a sheet element 2 consisting of a multiplicity of basic elements 34 which are interconnected via webs 14, 15. An indentation 25 is produced by forming in each basic element 34 and forms the flow duct for the coolant after the sheet elements have been joined together. Cooling webs 33 rise in one direction and the bosses 26 in the other direction from the plane of the indentation 25. In the exemplary embodiment of FIG. 2, the cooling webs 33 are designed as ribs running at an inclination to the longitudinal direction of the basic element 34. In the region of the ends 8,9, on both sides of the basic elements 34, overflow orifices 7 are cut out, which by means of a correspondingly large cross section, together with the connection pieces 6 connecting the disks, form a collecting duct 17 for a coolant which extends over the part length of the disk block shown in FIG. 1.

During the assembly of the disk-type evaporator, the sheet elements 2, which consist of a number of basic elements 34 corresponding to the desired depths of the evaporator block, are joined together sealingly in pairs in the region of their edges 53 so as to enclose the cavity for conducting the coolant. The disks can thus be designed as disk modules of variable depth, which each comprise a plurality of basic elements 34. The sheet element 2 is produced, according to the length of its semifinished product, with a multiplicity of basic elements 34, for example by stamping. The basic elements 34 are interconnected as one piece by means of the webs 14,15, the webs 14,15 preferably being provided at adjacent ends 8,9 of the elongate basic elements 34.

Figure 3:
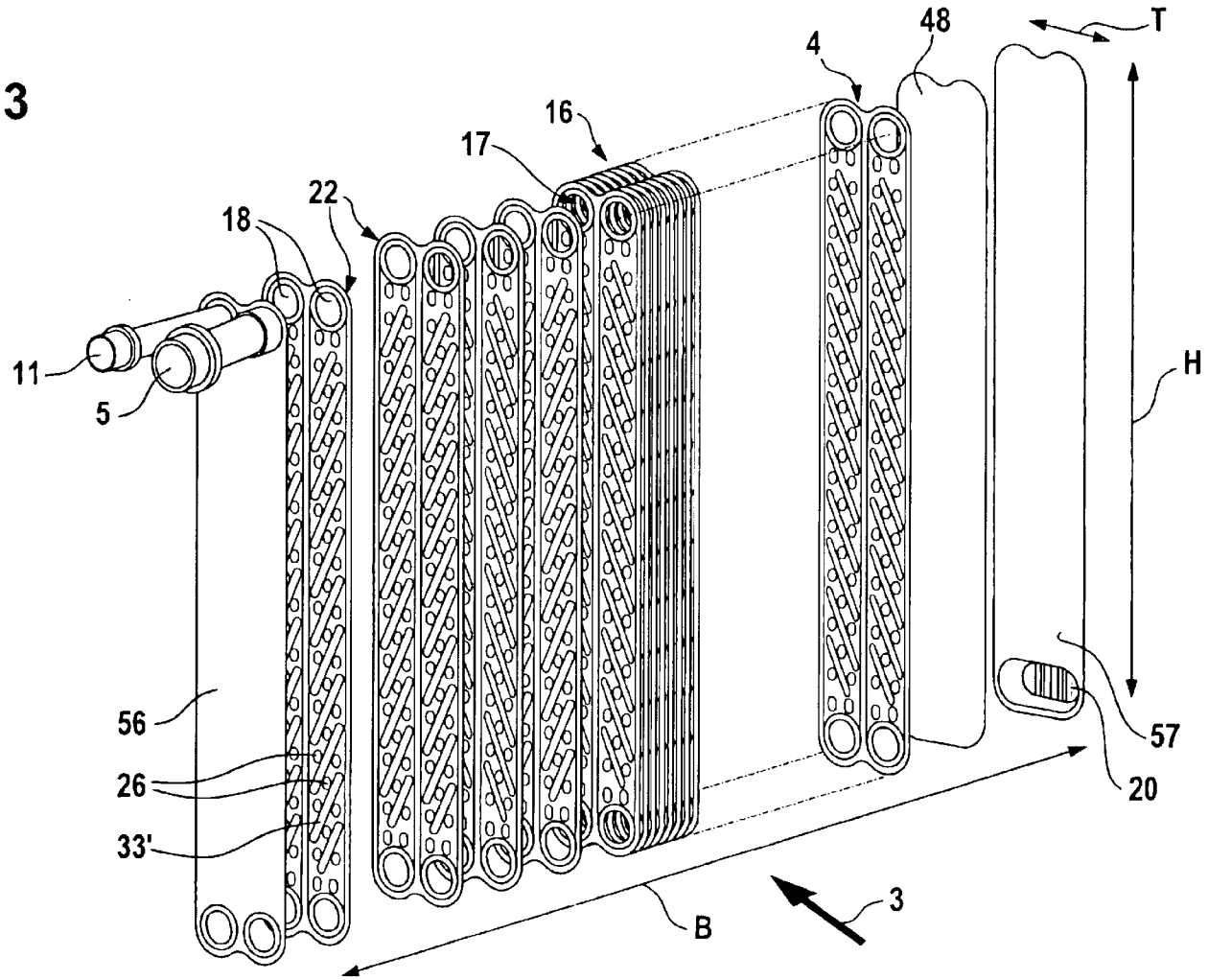

FIG. 3 shows a heat exchanger 1 comprising a disk stack 16 which is constructed from sheets 22. In each case two identical sheets 22 are joined together, rotated through 180° relative to one another about the longitudinal axis, and thus form a disk 4, as is evident from FIG. 5. The sheets 22 forming a disk 4 may also have a different structure, in particular two mirror-symmetrically designed sheets may be joined together to form a disk. The sheets 22 possess, at their ends arranged in the longitudinal direction, in each case two rim holes 18 which are arranged next to one another along the width of the sheets 22 and which form altogether four collecting ducts 17. Each collecting duct 17 extends along the width B of the heat exchanger 1. Each disk 4 comprises a cavity containing two ducts which are delimited by a middle web 13 and two edge webs 12 and by the insides of the sheets 22. The ducts extend in the longitudinal direction of the disks 4, that is to say in the direction of the height H of the heat exchanger 1. Inside the disks 4, the internal fluid, for example a coolant, flows in the ducts.

The external fluid flows, perpendicularly to the direction of flow of the internal fluid, in the direction indicated by the arrow 3. Bosses 26 directed toward the inside of the disk and beads 33' directed toward the outside of the disk and acting as cooling webs are arranged on the sheets 22. The disk stack 16 is constructed from stacked disks 4. On the sides directed toward the insides of the disk, the sheets 22 which form a disk 4 are soldered to one another at the bosses 26 which are in contact with one another, at the middle web 13 and at the edge webs 12. The individual disks 4 are soldered to one another at the contact points of the beads 33' and of the rim holes 18. The rim holes 18 are in contact with one another on an annular surface 49 (FIG. 4) which constitutes a good bearing surface for soldering. The bosses 26 and the beads 33' are advantageously produced by deep drawing or stamping. The webs 12,13, the elevations formed by the beads 33' and bosses 26 and the rim holes 18 are advantageously produced in a die.

The disk stack 16 is delimited on one side, in the direction of the width B of the heat exchanger 1, by an end disk 56 which is formed from a sheet and which has an inlet 11 and an outlet 5 for the internal fluid. The inlet 11 and the outlet 5 are designed as tubular connections, the outlet 5 having a larger diameter than the inlet 11. On the opposite side of the heat exchanger 1, the disk stack 16 is delimited by the end disk 57 which is likewise formed from a sheet and which is connected via a connecting disk 48 to the disk stack 16. The connecting disk 48 has two orifices which correspond to the orifices of the two lower collecting ducts 17 and which are arranged congruently with these. The end disk 57 has a deflecting duct 20 which makes a fluidic connection between the two collecting ducts 17 connected to it. The deflecting duct 20 may also be designed, for example, as a tube.

Figure 4:
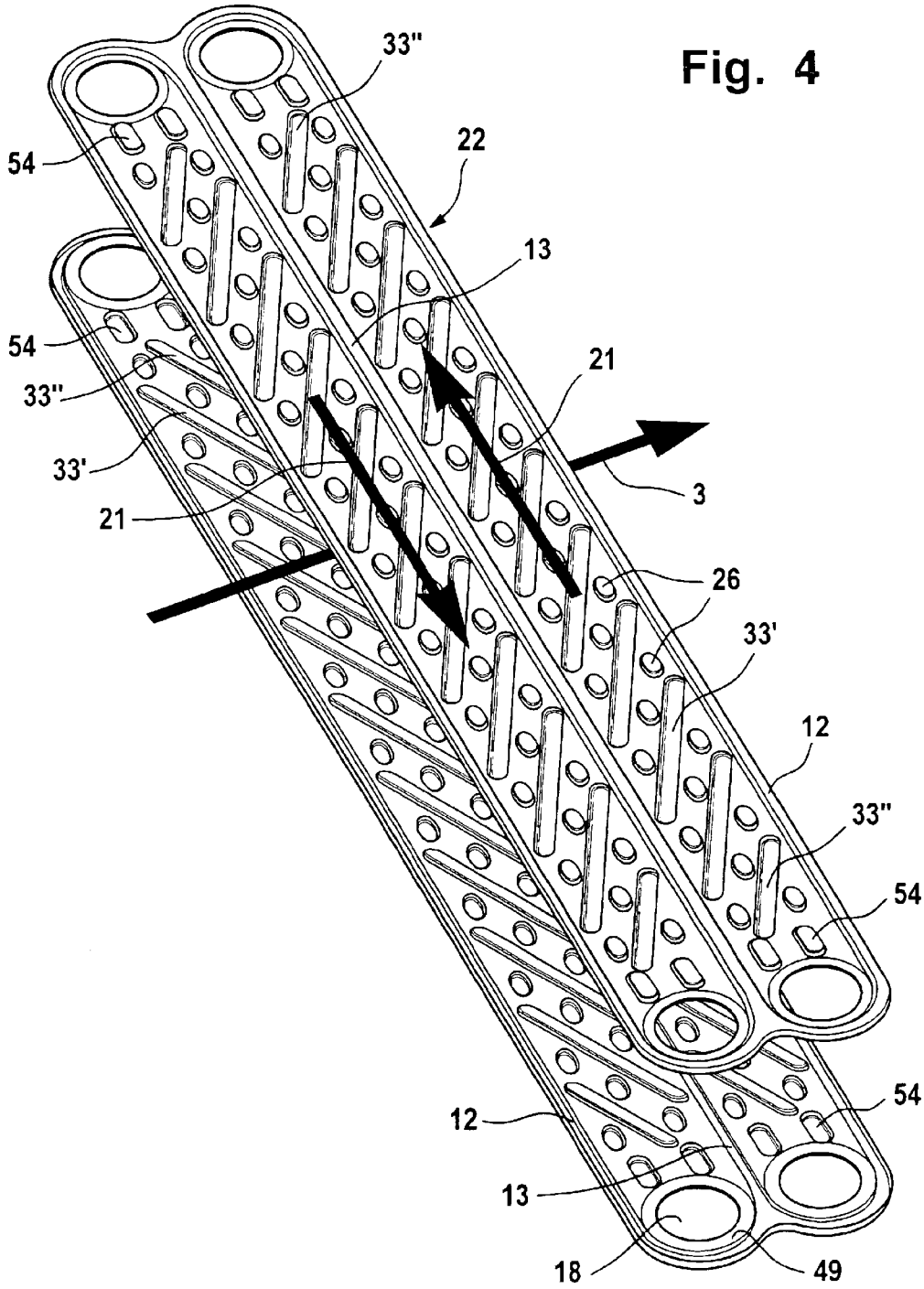
Figure 6:
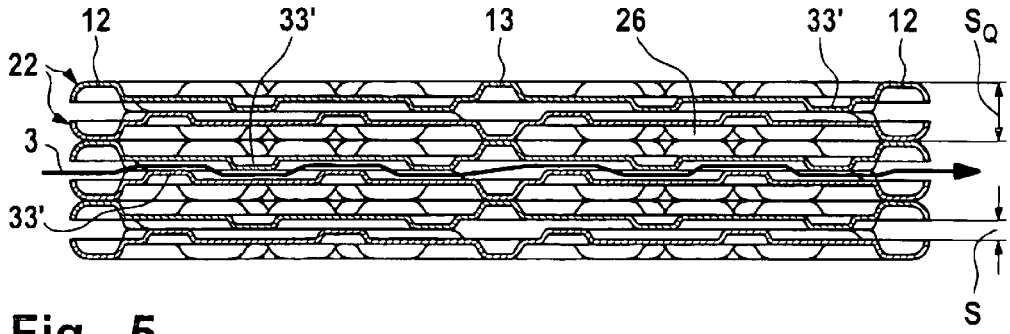

FIG. 4 illustrates two sheets 22, between which the external fluid flows in the direction illustrated by the arrow 3, on the side of the sheets 22 which is directed toward the outside of the disk. On the side of the sheets 22 which is directed toward the outside of the disk, the beads 33' are arranged transversely to the longitudinal direction of the sheets 22. The beads 33' are inclined to the longitudinal axis at an angle which may advantageously be approximately between 20° and 30°. However, angles of inclination deviating from this are also possible. The beads 33' are offset in the longitudinal direction of the sheets 22 by the length of the longitudinal portion L illustrated in FIG. 5. The length of the longitudinal portion L is, for example, 17.5 mm. Lengths deviating from this, in particular lengths of 15 mm to 35 mm, may also be expedient, particularly in the case of deviating inclinations of the beads 33'. The external fluid, when it passes the heat exchanger 1 in the direction of the arrow 3, is deflected both along the width B and along the height H of the heat exchanger 1 by the beads 33' on the outsides of the disks 4.

Bosses 26 are arranged on the side of the sheets 22 which is directed toward the inside of the disk and on which the internal fluid flows in the direction indicated by the arrow 21. In the exemplary embodiment, the bosses 26 are essentially oval-shaped and advantageously have a length of 3 mm to 7 mm, in particular of 4.6 mm, and a width of 2 mm to 4 mm, in particular of 2.7 mm. In each case two bosses 26 are arranged in the longitudinal direction of the sheets 22 in a longitudinal portion L on each sheet 22, at a duct, and one boss 26 is arranged at an interval in the longitudinal direction which corresponds approximately to half the length of the longitudinal portion L. In that region of the sheet 22 which is contiguous to the rim hole 18 are arranged two inflow bosses 54 which are directed toward the inside of the disk and which have a larger base than the bosses 26. The bead 33' contiguous to the inflow bosses 54 is shortened for reasons of space. The edge webs 12 follow the contour of the rim holes 18 in the region of these and, in the region of the middle web 13, merge into the latter, so that, when the insides of adjacent sheets 22 which form a disk 4 are joined together, each duct is closed off upwardly and downwardly and the internal fluid can flow out of the duct or into the duct only through the rim holes 18 forming the collecting ducts 17.

Figure 5:
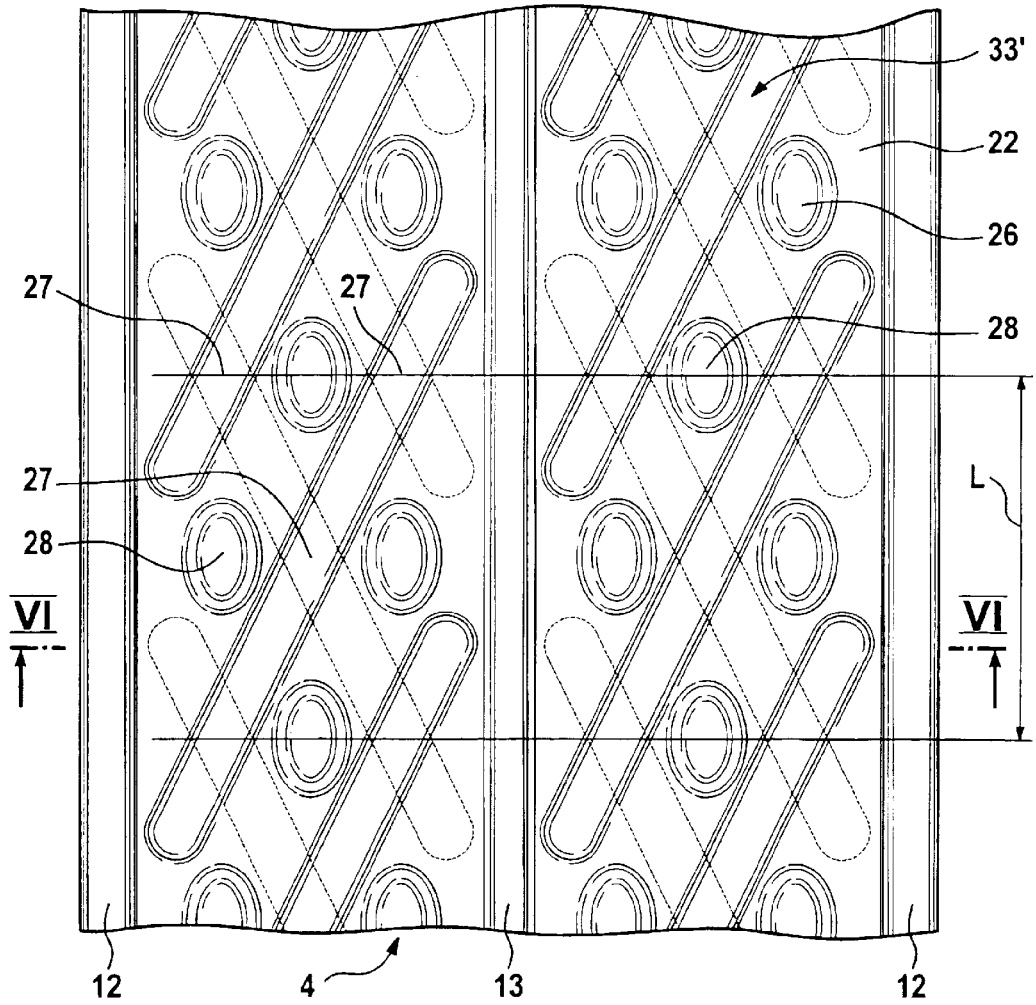

FIG. 5 illustrates the position of the elevations formed by the beads 33', 33" and bosses 26,54, in the direction of the width B of the heat exchanger 1. The beads 33' of adjacent disks 4 intersect one another at the three contact points 27 of each bead 33'. The beads 33' are soldered to one another at the contact points 27. The bosses 26 are arranged between the beads 33' on the opposite side of a sheet 22, bosses 26 of adjacent sheets 22 which form a disk 4 being in area contact with one another and being soldered to one another at contact surfaces 28.

It may be expedient for the bosses 26 to be only in punctiform contact with one another. As regards the beads 33', it may be expedient for these to be in area contact with one another. The edge webs 12 and the middle webs 13 of two sheets 22 forming a disk 4 are in contact with one another and are soldered to one another, the width of the contact surface being designed in such a way that good soldering is achieved.

A disk 4 has a height which corresponds to the transverse division $S_Q$. The inlet gap width S, through which the external fluid can flow in between two disks 4, is one quarter to three quarters, in particular about one third, of the transverse division $S_Q$. The arrow 3 indicating the direction of flow of the external fluid through the disk stack 16 illustrates the deflection of the external fluid by the beads 33' in the direction of the width B of the heat exchanger 1.

Figure 7:
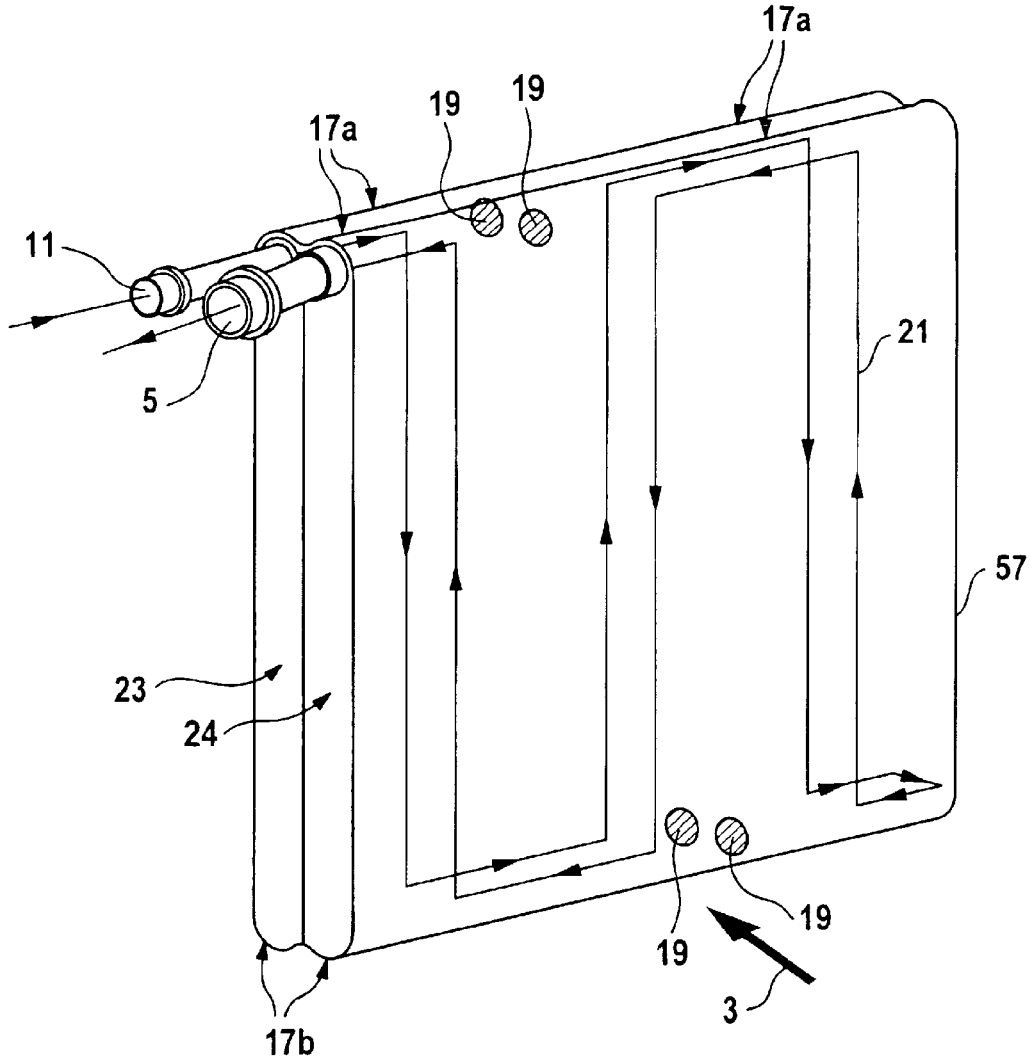

FIG. 7 illustrates the direction of flow 21 of the internal fluid through the heat exchanger 1 illustrated in FIG. 3. The internal fluid flows through the inlet 11 in a portion of the collecting duct 17 in the duct series 23 arranged downstream of the direction of flow of the external fluid. The inlet 11 and the outlet 5 issue into upper collecting ducts 17*a*, and the collecting ducts arranged in each case on the opposite side of the ducts are lower collecting ducts 17*b*. The four collecting ducts 17*a*, 17*b* are each divided by a partition 19 into two portions in each case. The internal fluid flows out of the first portion of the upper collecting duct 17*a* in ducts of the duct series 23 into a portion of the lower collecting duct 17*b*, from there into a portion of the upper collecting duct 17*a*, said portion being fluidically separated from the inlet 11 by a partition 19, and through further ducts of the duct series 23 into a further portion of the lower collecting duct 17*b* of the duct series 23.

In the end disk 57, the fluid is deflected from the duct series 23 into the duct series 24, which is arranged upstream of the direction of flow of the external fluid, and flows in said duct series, in the direction of flow opposite to the duct series 23, to the outlet 5 where it emerges from the heat exchanger 1. More than one partition 19 may be provided in a collecting duct 17. The partition 19 may be designed as a separate component. It may, however, also be integrated in a sheet 22 in which, for example, instead of the rim hole 18, only one elevation is arranged as a soldering point.

Figure 8:
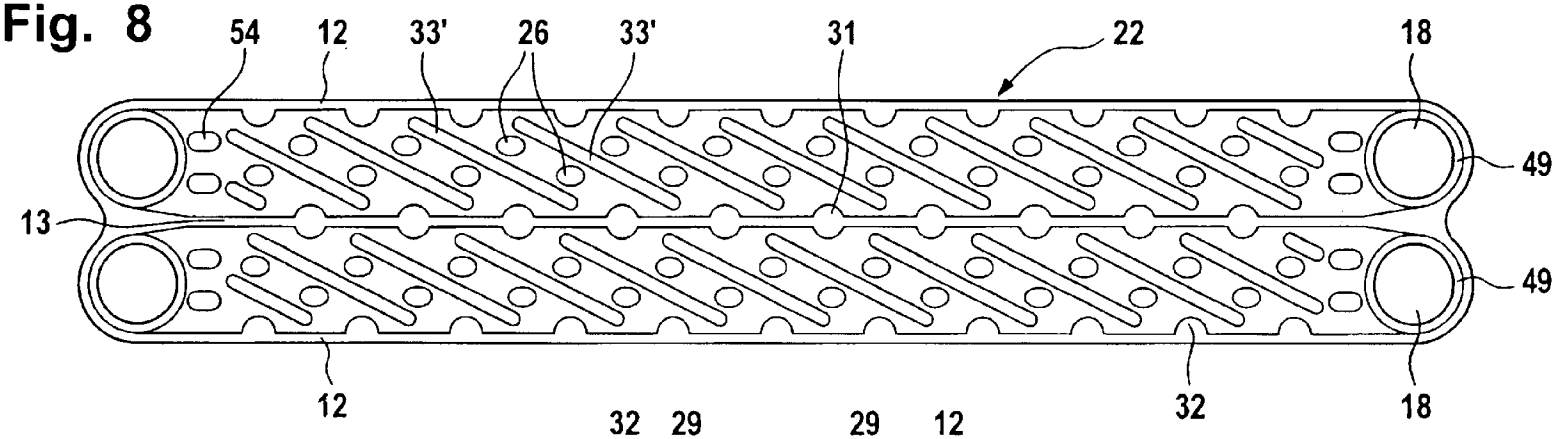
FIG. 8 shows a further embodiment of the sheets.
Figure 9:
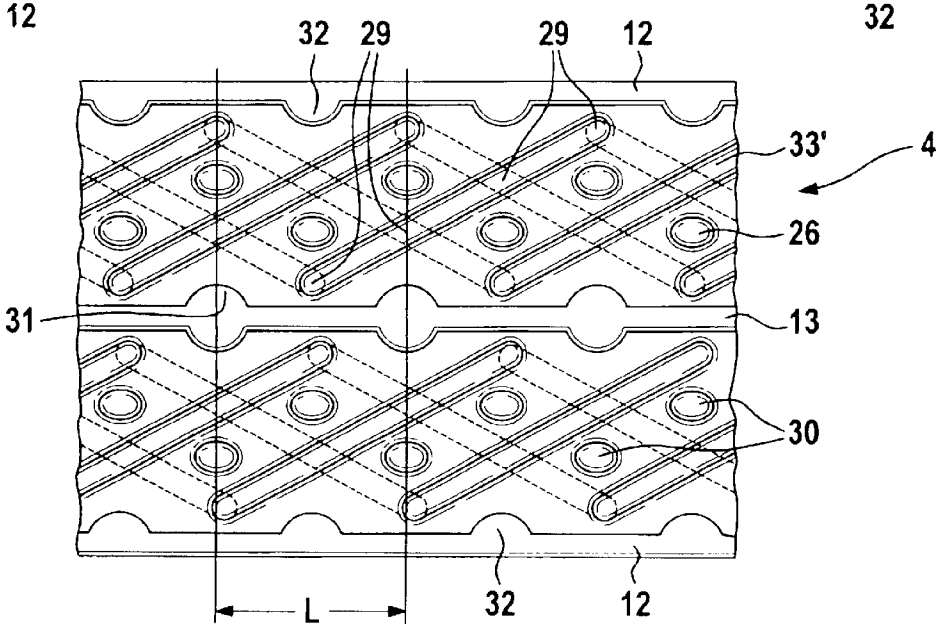
FIG. 9 shows a detail of a view of a disk according to FIG. 8.

FIGS. 8 and 9 show a further arrangement of the beads 33' and of the bosses 26 on a disk 4. Two bosses 26 are arranged in each case between two beads 33' which are inclined to the longitudinal axis of the sheet 22. In a disk 4 illustrated in FIG. 9, the beads 33' are in contact with one another in each case at four contact points 29 on each bead 33'. In the longitudinal direction of the disks 4, the beads 33' have approximately one and a half times the length of the longitudinal portion L. The bosses 26 are in each case arranged in a space formed by the beads 33' of two adjacent disks 4. The bosses 26 are in area contact with one another at contact points 30 and are soldered to one another. The middle web 13 has widenings 31 and the edge webs 12 have widenings 32. The widenings 31 and 32 correspond approximately to bosses 26 bisected in the longitudinal direction of the disk 4. The widenings 31,32 lead to increased stability of the disk 4.

Figure 10:
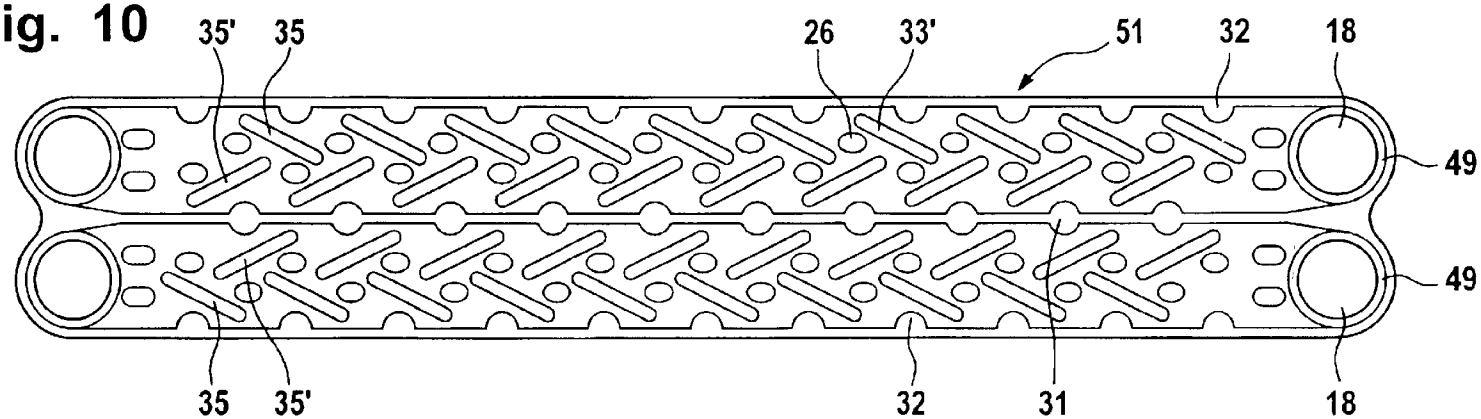
FIG. 10 shows a further embodiment of the sheets.
Figure 11:
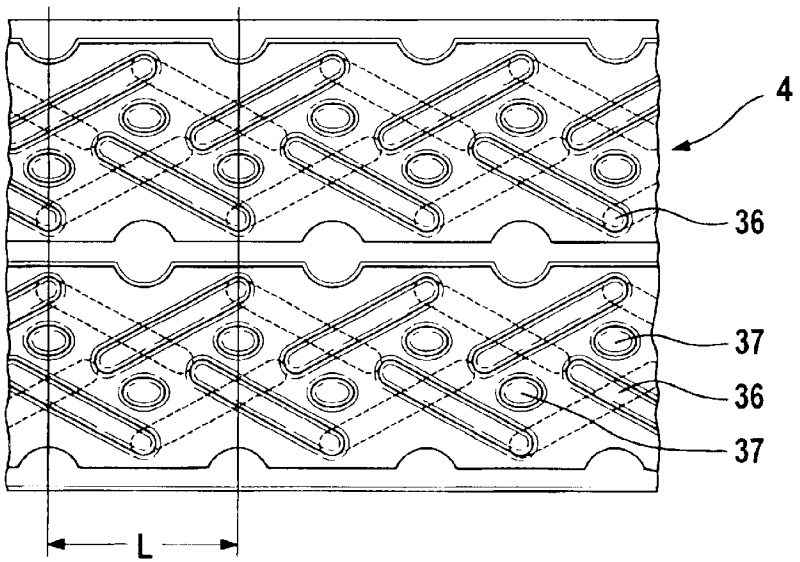
FIG. 11 shows a detail of a view of a disk according to FIG. 10.

FIGS. 10 and 11 illustrate a further arrangement of the elevations on a sheet 51. The beads 33' have, in the longitudinal direction of the sheet 51, a length which corresponds approximately to three quarters of the length of the longitudinal portion L. At each duct, two rows 35 and 35' of beads 33' are arranged, which are inclined to the longitudinal direction at opposite angles, but by the same angular amount. The bosses 26 are arranged according to the bosses 26 in FIGS. 8 and 9. In a disk 4 of sheets 51 which is illustrated in FIG. 11, a bead 33' of the row 35' is continued by a bead 33' of the row 35 of a sheet 51 which is adjacent to the outside of the disk. The beads 33' of the rows 35' and 35 have in each case two contact points 36 with beads 33' of adjacent disks 4. The bosses 26 have contact surfaces 37 within a disk 4. The formation of the beads 33' in two rows 35 and 35' leads to a more pronounced deflection of the external fluid in the direction of the width B of the heat exchanger 1.

FIGS. 12 to 14 illustrate a further design variant of a sheet 41. The elevations projecting onto the inside of a disk formed from two sheets 41 are designed as beads 44. The beads 45 projecting onto the outside of the disks have, in part, a small height a and, in a middle region, a large height b (FIG. 14). The ratio of the small height a to the large height b is, in particular, 0.2 to 0.8.

The beads 44 and 45 are arranged in two rows 42,43 at each duct, the beads 44,45 in a row 42 being inclined in the opposite direction to, but by the same angular amount in relation to the longitudinal direction as the beads in a row 43.

Beads 44 directed toward the inside of a disk and beads 45 directed toward the outside are arranged alternately in the longitudinal direction of the sheet 41. In this case, a bead 44 and a bead 45 are arranged in each row in each longitudinal portion L.

FIG. 13 illustrates a sheet 41 with the outward-directed beads 45 of an adjacent sheet 41. This arrangement arises as a result of the joining together of two identical sheets rotated through 180° relative to one another about the longitudinal axis. The beads 45 of adjacent sheets 41 are in this case soldered at contact points 46, and the beads 44 at contact points 47. In order to achieve contact surfaces, however, sheets 41 may also be joined together with sheets having a mirror-symmetrical arrangement of the beads 44,45 to form disks.

FIG. 15 illustrates a sheet 50 which could likewise be used for the heat exchanger 1 illustrated in FIG. 3. This sheet 50 has, at the longitudinal ends, the rim holes 18 which, in the assembled stack, form the collecting ducts 17. The edge webs 12 extend along the edge of the sheet 50 and the middle web 13 extends along the longitudinal mid-plane. A regular arrangement of beads 52,52' and of bosses 55 is provided in each case in the regions between an edge web 12 and the middle web 13, the beads 52, 52' being shaped in a direction out of the sheet plane and the bosses 55 extending in the opposite direction. As is evident from FIG. 15, the beads 52 have a length which is dimensioned such that it corresponds approximately to half the distance between the middle web 13 and the edge web 12. Since, as seen in the longitudinal direction of the sheet 50, a bead 52* is arranged offset between two rows of beads 52 lying one behind the other, short beads 52' are provided in alignment with this offset bead 52*. The bosses 55 are arranged in each case between two beads 52, 52*, 52' running parallel to one another.

A design variant of the sheet 50 is shown in FIG. 16, the base of the sheet element 50 being identical to that according to FIG. 15. The arrangement of beads 58 and 58' is, however, different, and these in each case run with respect to their longitudinal direction at an angle $\alpha$ to the onflow direction according to arrow 3, the beads 58 running obliquely upward and the beads 58' obliquely downward, according to illustration in FIG. 17. Thus, in each case four beads 58, 58' of this kind form essentially a lozenge arrangement, two crossed beads 59 having been provided within this lozenge. Relatively short beads 60 arranged in a V-shaped manner are provided adjacent to the edge beads 12 and to the middle web 13. Between the various beads 58, 58', 59 and 60 are located the bosses 55 shaped out of the sheet plane toward the other side.

FIGS. 18 and 19 show further design variants of a sheet 50, FIGS. 18 and 19 in each case illustrating only a middle detail of the sheet 50 extending longitudinally. In both versions, beads 61, 62 and 63 are provided, which have different lengths, relatively longer beads 61, medium beads 62 and relatively short beads 63 being arranged at a different angle to the onflow direction according to arrow 3. It is clear that the density of the beads 61,62,63 in FIG. 19 is substantially greater than in FIG. 18, with the result that not only the heat-transmitting surface increases, but also, albeit to only a limited extent, the air-side pressure drop is influenced. As becomes clear from FIG. 19, moreover, crossed beads 64 are arranged there at specific points adjacent to the edge webs 12 and to the middle web 13.

As is evident from FIGS. 15 to 19, the bosses directed toward the inside of the disk are oval-shaped, while the outer beads have an elongate shape. In this case, the beads run preferably at an angle of about 30° to the direction of flow of the fluid passing through between the disks, this being particularly beneficial in flow terms. To be precise, it has been shown that, owing to the choice of the bead height and of the angle mentioned, no deflection of the air in the longitudinal direction of the disks takes place, so that also no detectable lengthening of the flow path between the disks occurs. In so far as the external pressure drop is to be reduced and the flow distribution over the disk height equalized, it is expedient to minimize the number of ribs intersecting one another on the outside, while care must of course be taken to ensure sufficient strength and solderability. By minimizing the soldering miniscuses, unfavorable velocity peaks of the flow in the region of the soldering miniscuses and dead zones in the flow distribution are avoided.

It has also proved particularly expedient to dimension the beads somewhat shorter with regard to their length and to offset them in relation to successive beads in each case. It is also considered advantageous to arrange beads of different lengths in a predetermined pattern, as illustrated, for example, in FIGS. 18 and 19. For example, beads of this kind may be designed with a length of about 3 mm and a width of about 1 mm. At the same time, the height of the beads should amount at most to half an inlet gap width between two adjacent disks. The bosses 26 on the inside have an oval shape with a width of approximately 1.5 mm and a length of approximately 2.5 mm.

The sheets 50 illustrated in FIGS. 15 and 16 are suitable, in particular, for disks of a disk-type evaporator, in which the disk has a minimum width of 20 mm and a minimum length of 100 mm. The length of a longitudinal portion within which the internal and external structure of elevations is repeated amounts to at least 10 mm. FIG. 20 shows a graph, in which the air-side pressure drop $\Delta p$ and the heat transmission capacity Q are plotted in relation to various forms of construction of the abovementioned exemplary embodiments. It is clear that, with a virtually constant heat transmission capacity Q, the air-side pressure drop $\Delta p$ may be markedly different, depending on the form of construction. In this case, the indication in the plane I for the exemplary embodiments according to FIGS. 8 to 11 stands in relation to the markedly lower pressure drop in the plane II for FIGS. 12 to 14 and to the even further reduced pressure drop in the plane III for the embodiments according to FIGS. 15 to 19.

In the graph shown in FIG. 21, in turn, the air-side pressure drop $\Delta p$ and the heat transmission capacity Q are indicated as a percentage and are plotted against the transverse division $S_Q$ or airgap width S. It is clear from this that the air-side pressure drop depends essentially on the airgap width and a satisfactory heat transmission capacity and an acceptable pressure drop are to be noted only in the region between ⅓ and ⅔ of the transverse division $S_Q$ or gap with S.

What is claimed is:

1. A heat exchanger suitable for use as a coolant evaporator, comprising:

a plurality of generally planar plates which are assembled to form a heat exchanger block or plate stack, wherein respective pairs of plates are joined together to enclose between them two discrete parallel ducts, which are delimited by the inside surfaces of the plates and by edge webs arranged on the longitudinal sides of paired plates and by a middle web arranged in the middle in the longitudinal direction of respective paired plates, the edge webs and middle webs projecting toward the inside of the plate pair and being brazed to one another in the inside and at the edge of the plates, said parallel ducts being capable of discrete streams of fluid flowing counter-currently in the respective ducts;

said stack of plate pairs forming a plurality of said parallel ducts for flow of a first fluid in the longitudinal direction of the plates, and respective pairs being separated from one another to form a plurality of passageways for a second fluid to flow on the outside of the plates essentially transversely to the direction of flow of the first fluid; and each plate having elevations protruding out of the plane of the plate, which are formed by material deformation, and the plates comprising elevations directed into the inside of the plate pairs and also toward the outside of the plate pairs, with the elevations directed toward the outside of the plate pairs being configured as elongated portions, wherein the elongated portions are shaped in the form of beads, and the beads in a plate have different lengths.

2. The heat exchanger as claimed in claim 1, wherein the beads have a width of 1 mm to 4 mm and a length of 3 mm to 50 mm.

3. The heat exchanger as claimed in claim 2, wherein adjacent plates are brazed to one another at contact points formed between intersecting beads of respective plate pairs.

4. The heat exchanger as claimed in claim 2, wherein the beads are produced with a different height over their length, with intersecting beads of plate pairs being brazed together in regions of larger height (b).

5. The heat exchanger as claimed in claim 4, wherein the beads have two heights, the ratio of the small height (a) to the large height (b) being 0.2 to 0.8.

6. The heat exchanger as claimed in claim 1, wherein said elevations of the plates which are directed toward the inside of the plate pairs are designed as generally round bosses.

7. The heat exchanger as claimed in claim 6, wherein the bosses have an oval base with a width of 1.5 mm to 4 mm and a length of 2.5 mm to 25 mm.

8. The heat exchanger as claimed in claim 6, wherein plates forming a plate pair are brazed to one another at contact surfaces formed by bosses which are in contact with one another.

9. The heat exchanger as claimed in claim 1, wherein said elevations of the plates which are directed toward the inside of the plate pairs are designed as beads.

10. The heat exchanger as claimed in claim 9, wherein plates forming a plate pair are brazed at contact points formed by intersecting beads.

11. The heat exchanger as claimed in claim 1, wherein the plates have a wall thickness of 0.25 mm to 0.40 mm.

12. An evaporator for an automotive air conditioning system, comprising the heat exchanger as defined by claim 11.

13. The heat exchanger as claimed in claim 1, wherein the plates have a width of 20 mm to 75 mm and a length of 100 mm to 270 mm.

14. The heat exchanger as claimed in claim 1, the ducts have a width of 7.5 mm to 40 mm.

15. The heat exchanger as claimed in claim 1, wherein the beads are arranged at an acute angle ($\alpha$) with respect to the longitudinal direction of the plate.

16. The heat exchanger as claimed in claim 15, wherein, the angle ($\alpha$) is about 30°.

17. The heat exchanger as claimed in claim 1, wherein the elevations are arranged on the plate in a pattern which is repeated according to a longitudinal portion (L) of the plate, the length of the longitudinal portion (L) being 10 mm to 35 mm.

18. The heat exchanger as claimed in claim 17, wherein at least two elevations directed toward the inside are formed on a plate in each longitudinal portion (L) in the longitudinal direction of a plate.

19. The heat exchanger as claimed in claim 1, wherein the ratio of the transverse division ($S_Q$), which designates the total distance between adjacent plate pair centers, to the inlet gap width (S), which designates the width of the passageway through which the second fluid can flow between two plates pairs adjacent to one another, is from 4:3 to 4:1.

20. The heat exchanger as claimed in claim 1, wherein the elevations are produced by deep drawing.

21. The heat exchanger as claimed in claim 20, wherein the elevations are formed in a regular arrangement of beads forming the shape of a lozenge, two crossed beads arranged within the lozenge area and V-shaped beads arranged adjacent to the edge webs and to the middle web.

22. The heat exchanger as claimed in claim 20, wherein the beads run, in part, in alignment and, in part, offset to one another.

23. The heat exchanger as claimed in claim 1, wherein each of said channels includes a through-hole formed at both ends of the channel, passing through both plates of each plate pair.

24. The heat exchanger as claimed in claim 23, wherein corresponding through-holes of adjacent plate pairs cooperate to form respective collection ducts.

* * * * *